US006247345B1

(12) United States Patent
Donini et al.

(10) Patent No.: US 6,247,345 B1
(45) Date of Patent: Jun. 19, 2001

(54) BENDING BLOCK FOR FOUR-HIGH ROLLING STAND

(75) Inventors: Estore Donini, Vimercate; Giacinto Dal Pan, Cellatica, both of (IT)

(73) Assignee: Danieli & C. Officine Meccaniche, Buttrio (IT)

( * ) Notice: Subject to any disclaimer, the term of this patent is extended or adjusted under 35 U.S.C. 154(b) by 0 days.

(21) Appl. No.: 09/582,349

(22) PCT Filed: Dec. 21, 1998

(86) PCT No.: PCT/IB98/02097

§ 371 Date: Jul. 20, 2000

§ 102(e) Date: Jul. 20, 2000

(87) PCT Pub. No.: WO99/33586

PCT Pub. Date: Jul. 8, 1999

(30) Foreign Application Priority Data

Dec. 24, 1997 (IT) ..... VD97A0244

(51) Int. Cl.[7] ..... B21B 13/14; B21B 31/07
(52) U.S. Cl. ..... 72/241.8; 72/247
(58) Field of Search ..... 72/241.8, 245, 72/241.4, 247

(56) References Cited

U.S. PATENT DOCUMENTS

| | | | | |
|---|---|---|---|---|
| 4,038,857 | | 8/1977 | Eibe et al. . | |
| 4,491,005 | * | 1/1985 | Kimura et al. | 72/241.8 |
| 4,499,748 | * | 2/1985 | Nihei et al. | 72/241.8 |
| 4,773,246 | | 9/1988 | Perret . | |
| 5,638,716 | * | 6/1997 | Jonen | 72/241.8 |
| 5,813,268 | * | 9/1998 | Donini et al. | 72/241.8 |

FOREIGN PATENT DOCUMENTS

| | | |
|---|---|---|
| 0084927 | 8/1983 | (EP) . |
| 0744227 | 11/1996 | (EP) . |
| 0744228 | 11/1996 | (EP) . |
| 59-066906 | 4/1984 | (JP) . |
| 60-118310 | 6/1985 | (JP) . |

* cited by examiner

*Primary Examiner*—Rodney A. Butler
(74) *Attorney, Agent, or Firm*—Stevens, Davis, Miller & Mosher, LLP

(57) ABSTRACT

A bending block for a four-high rolling stand comprising working rolls (11*a,* 11*b*) and back-up rolls (12*a,* 12*b*) associated with respective chocks (14*a,* 14*b;* 15*a,* 15*b*), the stand also comprising a stationary housing (16) associated with means (17) for the crossing of the rolls, the working rolls (11*a,* 11*b*) being able to be translated axially. The crossing means (17) cooperating with the outer lateral faces of the chocks (14*a,* 14*b*) at least of the working rolls (11*a,* 11*b*) by means of intermediate plates to distribute the thrust. There also being included bending jacks to bend at least the working rolls (11*a,* 11*b* ), the intermediate plates to distribute the thrust consisting of gibs (18) shaped like a vertical plate (19) with at least two fins (20, 21) orthogonal to the vertical plate (19), the two fins (20, 21) being arranged on one side and the other astride a fin extension (114) of the chock (14) of the relative working roll (11), the two fins (20, 21) defining the respective positioning seating (23) for the bending jacks (24*a,* 24*b*). There also being included between the crossing means (17) and the relative gib (18) a containing and guiding plate (25).

6 Claims, 2 Drawing Sheets

BENDING BLOCK FOR FOUR-HIGH ROLLING STAND

FIELD OF THE INVENTION

This invention concerns a bending block for four-high rolling stands as set forth in the main claim.

The invention is used to achieve positive or negative pre-defined bending of the working rolls and/or the back-up rolls in a four-high rolling stand so as to contrast or facilitate the deflections generated on the rolls during the rolling cycles.

The invention is applied in rolling stands which include not only bending of the rolls but also movement of the rolls under load, that is to say, with the bending elements acting on the chocks of the rolls in order to perform shifting and also crossing movements of the working rolls.

BACKGROUND OF THE INVENTION

In four-high rolling stands for strip and sheet the state of the art includes the use of bending and possibly balancing blocks in cooperation with the chocks on which the rolls are mounted.

These bending and balancing blocks include jacks, or more generally compression units, which act on the two sides of the chocks to generate a greater or lesser thrust so as to bend the relative roll in a manner correlated, among other things, to the deflection to which the roll is subjected during the rolling process, to the mechanical rounding of the rolls, to their thermal expansion and their wear.

The jacks act alternately on the two faces, upper or lower, of the relative chocks so that, when driven, they can impart a positive bend ("IN" bend), if the bend contrasts the flection of the rolls generated by the rolling load, or a negative bend ("OUT" bend), if the bend acts to increase the flection of the rolls.

U.S. Pat. Nos. 4,773,246, 4,038,857, 4,976,128 and 3,307,386 show some examples of four-high rolling stands equipped with bending and balancing blocks.

The state of the art also covers the need to induce two different movements on the working rolls: a crossing movement on the rolling plane, which causes the rolls to assume a reciprocally crossed position, which may be performed both during the working step and during the initial set-up step of the stand, and also an axial movement, or shifting, of one roll with respect to the other.

In order to achieve this crossing of the rolls, a plurality of solutions have been proposed in the state of the art, for example including screws, gears, jacks, etc.

Moreover, solutions have been proposed which include the use of cam or eccentric elements laterally coupled with the outer face of the chock and suitable to cause it to be laterally displaced in response to a rotation imparted thereto in order to cross over the rolls.

The cam or eccentric elements do not normally act directly on the outer lateral face of the chock, but on intermediate elements, such as gibs, plates or similar.

Some embodiments have been proposed where the intermediate elements are E-shaped or F-shaped so that the bending jacks which act on the relative chocks are housed on the fins defined by this shape.

Those embodiments known to the art where there is both bending and crossing of the rolls include either jacks mounted on extensions made directly on the housing of the stand (U.S. Pat. No. 3,307,386) or jacks mounted on the supporting fins or again jacks which, in order at least to induce the negative bend, are mounted on the chocks of the back-up rolls and act on the chock of the relative working roll.

In the first case, it is very complex and expensive to make the seatings for the jacks on the housings.

In the third case there is the problem that, when the rolls have to be dis-assembled and re-assembled with the relative chocks, it is necessary to disconnect and then reconnect the hydraulic system which feeds the jacks.

This disconnection, apart from causing a delay in the operations to change the rolls, causes a serious danger of infiltration of dirt into the connections, with consequent serious risks of damage to the servovalves and for the components of the oil-dynamic circuit.

Moreover, in this embodiment there is a need to use flexible cables to connect the jack, which is movable with the chock, to the relative feed circuit; these flexible cables cause operating difficulties in that they reduce the dynamic performance of the system which controls the pressure and force exerted by the jacks.

Another problem in the state of the art is that the ends of the pressure elements of the jacks slide on the fins of the chocks when the shifting and/or crossing movement is carried out in a condition of activated load.

A further problem is to achieve means to constrain/release the bending block, in a simple and rapid manner, either to/from the relative chock so that, during the working steps, the block follows the movements of axial translation imparted to the rolls, or to/from the stationary housing during the steps when the rolls are replaced and extracted.

Yet another problem is that the axes of the jacks, during the shifting movement, may be misaligned with respect to the centre line of the bearings of the working rolls; this causes a problem in that the load is not symmetrical and therefore there is a deterioration and premature wear of the bearings themselves.

EP-A-0 744 227, in the name of the applicant, discloses a device for the crossed displacement of rolling rolls, comprising motion transmission means and actuation means arranged at least on a side of a respective chock. It does not disclose means for performing positive or negative curvature of the rolls, i.e. the bending of the rolls.

EP-A-0 744 228, also in the name of the applicant, discloses a block to provide curvature of the rolling rolls in a four-high rolling stand, the block comprising lower and upper ribs including jack means cooperating with the opposite surfaces of the chocks and compensation jack means acting on the chocks of the corresponding back-up roll.

It does not solve the problems above mentioned, and in particular the problem of the sliding of the pressure elements of the jacks on the fins of the chocks when the shifting and/or crossing movements of the rolls are carried out, and of the misalignment of the axes of the jacks with respect to the center line of the bearings of the working rolls.

The present applicant has designed and tested this invention to overcome all these problems and to achieve further advantages as shown hereinafter.

SUMMARY OF THE INVENTION

According to the invention, both the jacks performing positive, or "IN" bending, and those performing negative, or "OUT" bending, associated with the chock of the working rolls in a four-high rolling stand are mounted on supporting fins made on plates or gibs arranged in an intermediate position between the face of the chock and the system performing the crossing movement of the rolls, whether this consists of a cam system, an eccentric system or other systems with the same function.

These intermediate plates or gibs, according to a variant, are C-shaped or F-shaped; the fins are positioned on one side and the other astride the fin of the chock which is subjected to the bending load, while the vertical element constitutes the wall receiving the thrust associated with the means which exert the lateral thrust to perform the crossing movement.

According to a variant, between the lateral thrust means and the "C" blocks wherein the jacks are housed, there is an intermediate element which defines a guiding seating inside which the vertical element of the "C" is positioned and moves in a direction substantially orthogonal to the axis of feed of the rolled stock.

This embodiment has numerous advantages.

First of all, the working rolls can be dis-assembled and re-assembled without having to disconnect and reconnect the hydraulic system which feeds the jacks, inasmuch as the jacks are not constrained to the chocks.

This obviates problems caused by any possible pollution of the oil, which might dirty the attachments and connections when the rolls are disconnected and dirt could enter the servovalves, causing damage and premature wear.

Therefore, the invention prolongs the working life of the servovalves, extends the duration of the other components of the oil dynamic circuit and obviates problems of infiltration of dirt and pollution which could block the working of the servovalves even suddenly.

Moreover, the invention substantially eliminates the necessity for long, flexible connections to feed the jacks, which do not follow the movement of the rolls, and therefore prevents any reduction, caused by these flexible connections, in the dynamic performance of the system which controls the pressure of the hydraulic fluid.

Moreover, it is easier to remove the jacks for maintenance and replacement operations.

Furthermore, it is easier to achieve the seatings to house the jacks inasmuch as it is not necessary to work on structural parts of the stand—which are difficult to work on even on sophisticated machine tools—since the seatings are made on parts which are limited in size.

According to a variant, since the crossing movement, even with movable blocks, induces a relative movement—be it ever so slight—between the jacks and fins of the chocks, at least some of the jacks used have the end of the relative pressure elements shaped like a spherical cap housed in a rotating containing cradle, in order to reduce the friction caused by the rubbing of the ends of the pressure elements of the jacks and the surface of the fins of the chocks.

This specific conformation of the pressure elements is the subject of a parallel patent application by the present Applicant.

According to the invention, each bending block includes bolt means suitable to assume a first position wherein they axially constrain the relative bending block to the relative chock of the roll so as to constitute a single body therewith in the movements of axial translation imparted to the rolls.

The bolt means also have a second position wherein they release the chocks from the relative bending blocks, at the same time constraining the blocks to the stationary housing of the stand.

This embodiment makes it possible to extract the rolls for grinding or replacement operations, at the same time maintaining the relative bending blocks in a correct stand-by position; this facilitates the operations to replace worn rolls with a pair of rolls which have been restored by means of a grinding operation.

The jacks remain positioned in a correct position with respect to the bearings of the working rolls, so that after re-positioning the bending load imparted still remains balanced and the bearings are preserved from premature wear and damage.

BRIEF DESCRIPTION OF THE DRAWINGS

The attached Figures are given as a non-restrictive example, and how a preferential embodiment of the invention as follows.

DETAILED DESCRIPTION OF THE PREFERRED EMBODIMENTS

Figure 1:
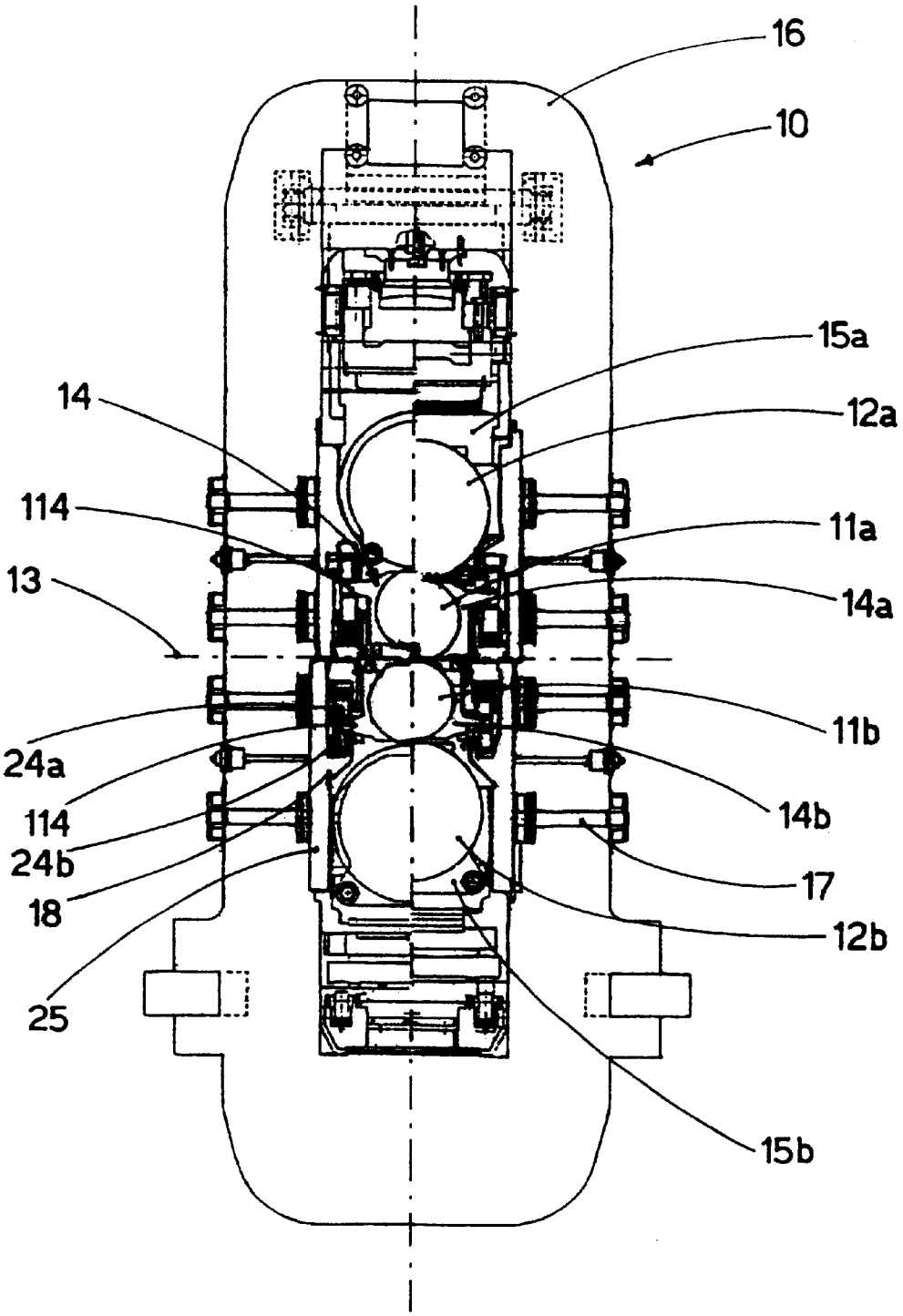
FIG. 1 shows a diagram of a four-high rolling stand to which the invention is applied.

The four-high rolling stand 10 shown in FIG. 1 includes working rolls 11*a* and 11*b* and back-up rolls 12*a* and 12*b* mounted in opposite positions with respect to the rolling plane 13.

The rolls are mounted on respective chocks, 14*a* and 14*b* for the working rolls 11*a* and 11*b,* and 15*a* and 15*b* for the back-up rolls 12*a* and 12*b*.

The outer structure of the stand 10 is defined by the stationary housing 16.

In cooperation with the stationary housing 16 there are means for the crossing of the rolls comprising thrust elements 17 acting on the relative chocks 14 and 15 by means of intermediate elements.

In this case, for each side of the stand 10, the intermediate elements consist of a guide and containing plate 25 inside of which the supporting gib 18 is positioned and moved, in a direction substantially orthogonal to the direction of feed of the rolled stock.

The supporting gib 18, in this case, is substantially C-shaped.

The gibs 18 support the thrust generated by the fact that the rolls, during the rolling cycle, are crossed in a condition of active load; the thrust is discharged from the chock 14, 15 to the relative C-shaped gibs 18, and from the gibs 18 to the thrust elements 17.

In this case, the gibs 18 have a vertical plate structure 19 equipped with an upper fin 20 and a lower fin 21 which extend substantially orthogonal to the vertical plate 19.

The fins 20 and 21, in this case, are structured so as to be positioned respectively on one side and the other of relative fins 114 on the chocks 14*a* and 14*b* of the working rolls 11*a* and 11*b* and define a housing seating 23 for a relative jack, respectively an upper jack 24*a* and a lower jack 24*b*.

The jacks 24*a* and 24*b* are arranged with their respective longitudinal axes substantially aligned; they act, respectively from above and from below, on the relative fin 114 to impart the desired bend, positive or "IN", and negative or "OUT", to the relative working roll 11*a,* 11*b*.

As can be seen from the Figures, the working rolls 11*a,* 11*b* can be dis-assembled and re-assembled without any intervention being necessary on the attachments and connections of the hydraulic circuit which feeds the jacks, so that there are no problems of pollution or dirt.

Moreover, it is much easier to maintain and inspect the jacks 24*a,* 24*b,* since it is possible to intervene only on the C-shaped gibs 18, without any intervention being needed on the rolls or the chocks.

Figure 2:
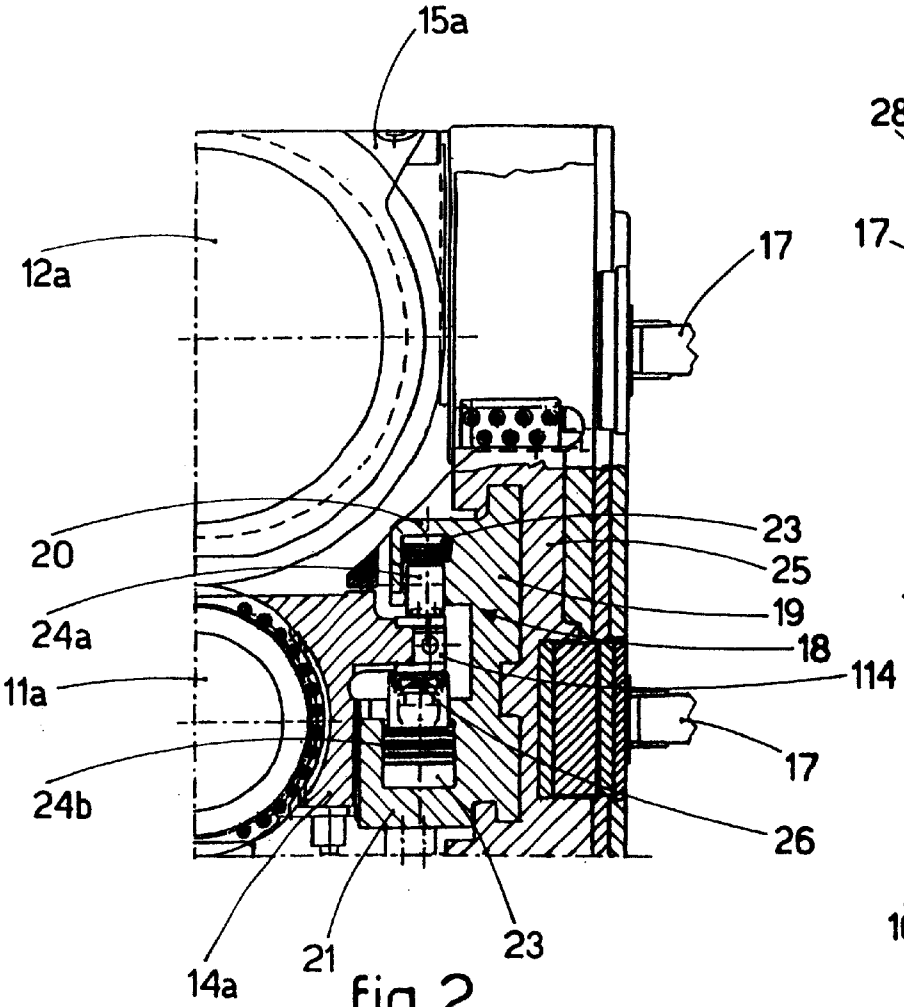
FIG. 2 shows the bending block according to the invention on a large scale and in part section.

In this case, at least some of the jacks 24*a,* 24*b* have the end of the relative pressure element shaped like a spherical cap (detail 26 in FIG. 2) as in the parallel patent application in the name of the Applicant.

This conformation reduces the sliding friction between the end of the pressure element and the surface of the fin 114 of the relative chock 14 during the crossing movements of the working rolls 11*a,* 11*b* and when the bending load imparted to the jacks 24*a,* 24*b* is activated.

This friction occurs because during the crossing movement of the rolls there is a component, which cannot be compensated, of the relative movement along the axis 29.

In this case, the invention includes bolt means 22 (FIG. 3) arranged for each of the chocks 14 in a longitudinal position extending between the stationary housing 16 and the chock 14.

Figure 3:
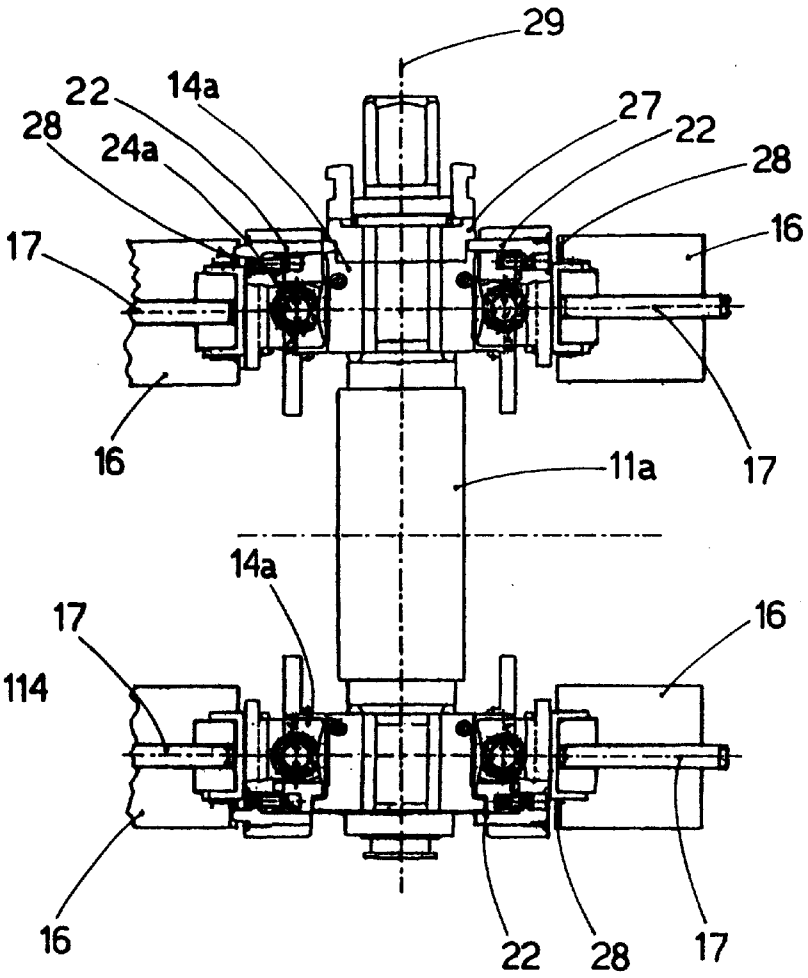
FIG. 3 shows a transverse section of the rolling stand as shown in FIG. 1 taken on a plane parallel to the rolling plane.

The bolt means 22 have a first operating position, shown on the right side of FIG. 3, wherein they are inserted on at least one front of the stand 10 between the chock 14 and the relative bending block in cooperation with an abutment edge 27.

The first operating position makes the roll 11 and the relative chock 14 solid with the relative bending block so as to constitute a single body during the shifting movements imparted to the rolls 11 during rolling.

It is thus possible to carry out the shifting movements while still maintaining the jacks 24*a,* 24*b* in their correct working position, that is, centered with respect to the fins 114 of the chocks 14, so that it is possible to maintain the bending loads aligned with the centre lines of the bearings of the working rolls.

By using this embodiment, even when shifting movements are performed the bearings are not loaded in an unsymmetrical manner, which would cause a deterioration in the working life of the bearings.

The bolt means 22 then assume a second operating position, as shown on the left side of FIG. 3, wherein they constrain the bending blocks to the stationary housing 16, at the same time releasing them from the relative chocks 14, and are inserted into a seating 28 made in the stationary seating 16.

In this position, the rolls 11 can be removed axially together with the relative chocks 14 in order to be replaced by a pair of restored rolls, while the bending blocks maintain an operationally correct position which facilitates the subsequent restoration, making it extremely quick and functional.

What is claimed is:

1. A bending block, for a four-high rolling stand comprising working rolls (11*a,* 11*b* ) and back-up rolls (12*a,* 12*b*), chocks (14*a,* 14*b;* 15*a,* 15*b*) respectively associated with the working rolls (11*a,* 11*b*) and backup rolls (12*a,* 12*b*), the working rolls (11*a,* 11*b*) being able to be translated axially, and a stationary housing (16), comprising, crossing means (17), associated with the stationary housing, for crossing the rolls, the crossing means (17) cooperating with the outer lateral faces of the chocks (14*a,* 14*b*) at least of the working rolls (11*a,* 11*b*) by means of intermediate plates to distribute the thrust, bending jacks, comprising relative pressure elements, to bend at least the working rolls (11*a,* 11*b*), wherein the intermediate plates, to distribute the thrust, consist of gibs (18) shaped like a vertical plate (19) with at least two fins (20, 21) orthogonal to the vertical plate (19), the two fins (20, 21) being arranged on one side and another side astride a fin extension (114) of the chock (14) of the relative working roll (11), the two fins (20, 21) defining the respective positioning seating (23) for the bending jacks (24*a,* 24*b*), and a containing and guiding plate (25) located between the crossing means (17) and the relative gib (18).

2. The bending block as in claim 1, in which at least some of the bending jacks (24*a,* 24*b*) have the end (26) of the relative pressure element acting on the fin extension (114) of the relative chock (14) shaped like a spherical cap (26).

3. The bending block as in claim 1, in which there are bolt means (22) in cooperation with the bending block and in a longitudinally intermediate position between the stationary housing (16) and the relative chock (14).

4. The bending block as in claim 2, in which there are bolt means (22) in cooperation with the bending block and in a longitudinally intermediate position between the stationary housing (16) and the relative chock (14).

5. The bending block as in claim 3, in which the bolt means (22) have a first operating position wherein said bolt means constrain the chock (14) to the relative bending block and a second operating position wherein said bolt means constrain the bending block to the stationary housing (16).

6. The bending block as in claim 5, in which said bolt means (22) are able to assume said first operating position during the rolling cycle of said stand.

* * * * *

UNITED STATES PATENT AND TRADEMARK OFFICE

CERTIFICATE OF CORRECTION

PATENT NO. : 6,247,345 B1
DATED : June 19, 2001
INVENTOR(S) : Estore Donini et al.

It is certified that error appears in the above-identified patent and that said Letters Patent is hereby corrected as shown below:

Title page,
Item [73], Assignee is -- Danieli & C. Officine Meccaniche SpA. --

Signed and Sealed this

Twenty-third Day of April, 2002

*Attest:*

*Attesting Officer*

JAMES E. ROGAN
*Director of the United States Patent and Trademark Office*